US009385446B2

(12) United States Patent
Palinkas et al.

(10) Patent No.: US 9,385,446 B2
(45) Date of Patent: Jul. 5, 2016

(54) CONNECTOR ASSEMBLY, PORT ACCESSORY AND METHOD FOR SLIDE-ON ATTACHMENT TO INTERFACE PORTS

(71) Applicant: PPC Broadband, Inc., East Syracuse, NY (US)

(72) Inventors: Raymond W. Palinkas, Canastota, NY (US); Noah P. Montena, Syracuse, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 63 days.

(21) Appl. No.: 14/264,548

(22) Filed: Apr. 29, 2014

(65) Prior Publication Data

US 2014/0322969 A1 Oct. 30, 2014

Related U.S. Application Data

(60) Provisional application No. 61/817,764, filed on Apr. 30, 2013.

(51) Int. Cl.
*H01R 9/05* (2006.01)

(52) U.S. Cl.
CPC ..... *H01R 9/0527* (2013.01); *Y10T 29/49117* (2015.01)

(58) Field of Classification Search
CPC ..... H01R 2103/00; H01R 9/0521; H01R 13/6275
USPC ..... 439/578, 584, 353, 349
See application file for complete search history.

(56) References Cited

U.S. PATENT DOCUMENTS

| | | | | |
|---|---|---|---|---|
| 2,762,025 | A | 9/1956 | Melcher | |
| 2,877,437 | A * | 3/1959 | Flanagan, Jr. | H01R 13/6277 285/116 |
| 2,986,720 | A | 5/1961 | Chess | |
| 3,793,610 | A * | 2/1974 | Brishka | H01R 13/6277 439/349 |
| 5,074,809 | A | 12/1991 | Rousseau | |
| 5,137,471 | A | 8/1992 | Verespej et al. | |
| 5,273,458 | A | 12/1993 | Fisher, Jr. et al. | |
| 5,611,707 | A | 3/1997 | Meynier | |
| 7,238,047 | B2 * | 7/2007 | Saettele | H01R 13/627 439/253 |
| 7,811,112 | B2 | 10/2010 | Montena | |
| 7,972,173 | B1 * | 7/2011 | Hyzin | H01R 13/2421 439/578 |
| 8,388,377 | B2 | 3/2013 | Zraik | |
| 8,414,322 | B2 | 4/2013 | Montena | |
| 8,430,687 | B2 | 4/2013 | Zraik | |
| 8,491,333 | B2 | 7/2013 | Evans | |
| 2012/0021642 | A1 | 1/2012 | Zraik | |
| 2012/0028499 | A1 | 2/2012 | Zraik | |
| 2012/0252264 | A1 | 10/2012 | Zraik | |
| 2012/0252268 | A1 | 10/2012 | Zraik | |
| 2012/0270440 | A1 | 10/2012 | Zraik | |
| 2015/0180183 | A1 * | 6/2015 | Watkins | H01R 13/6581 439/578 |

* cited by examiner

*Primary Examiner* — Hae Moon Hyeon
(74) *Attorney, Agent, or Firm* — Barclay Damon, LLP

(57) ABSTRACT

A connector assembly and method including a post, a port body, a post engager, an actuator and a spring assembly. The post engager is configured to engage the post in a first operating mode while the actuator is configured to release the post engager from the post in a second operating mode. The spring assembly is operably coupled to the post engager and is configured to axially bias the post against the port body during the first operating mode to facilitate an electrical ground path between the port body and the post.

20 Claims, 11 Drawing Sheets

CONNECTOR ASSEMBLY, PORT ACCESSORY AND METHOD FOR SLIDE-ON ATTACHMENT TO INTERFACE PORTS

PRIORITY CLAIM

This application is a non-provisional of, and claims the benefit and priority of, U.S. Provisional Patent Application No. 61/817,764, filed on Apr. 30, 2013. The entire contents of such application are hereby incorporated by reference.

BACKGROUND

Connectors for coaxial cables typically attach to complementary interface ports to electrically connect coaxial cables to various electronic devices within a telecommunications, cable/satellite TV ("CATV") network. It is desirable to maintain electrical continuity through a coaxial cable connector to prevent radio frequency (RF) leakage and ensure a stable ground connection.

Certain connectors attempt to eliminate the use of threads for a quicker installation method. Such connectors use a locking pin for coupling to another component. While these connectors eliminate the requirement for multiple turns/revolutions of a threaded nut to effect engagement, such connectors do not provide a positive locking force between the components. As a result, such connectors have problems of RF leakage, i.e., ingress or egress, of RF energy through gaps along the locked connection. Additionally, such gaps provide an opportunity for the loss or interruption of a ground path from the coaxial cable to a grounded interface port. These problems can cause a loss or decrease in the quality of CATV signals passing through the connector, impairing the performance of devices such as televisions, computers and phones.

Therefore, there is a need to overcome, or otherwise lessen the effects of, the disadvantages and shortcomings described above.

SUMMARY

In one embodiment, an interface port accessory is provided which comprises a port body, a post engager, an actuator and a spring assembly. The port body is configured to receive a portion of a coaxial cable and is extendable along an axis. The post engager is configured to alternate between first and second operating modes. In the first operating mode, the post is configured to engage a post of a coaxial cable. In a second operating mode, an actuator is configured to translate axially along the axis to release the post engager from the post. A spring assembly is operably coupled to the post engager and is configured to axially bias the post against the port body during the first operating mode to facilitate an electrical ground path between the port body and the post.

Additional features and advantages of the present disclosure are described in, and will be apparent from, the following Brief Description of the Drawings and Detailed Description.

DETAILED DESCRIPTION

Network and Interfaces

Figure 1:
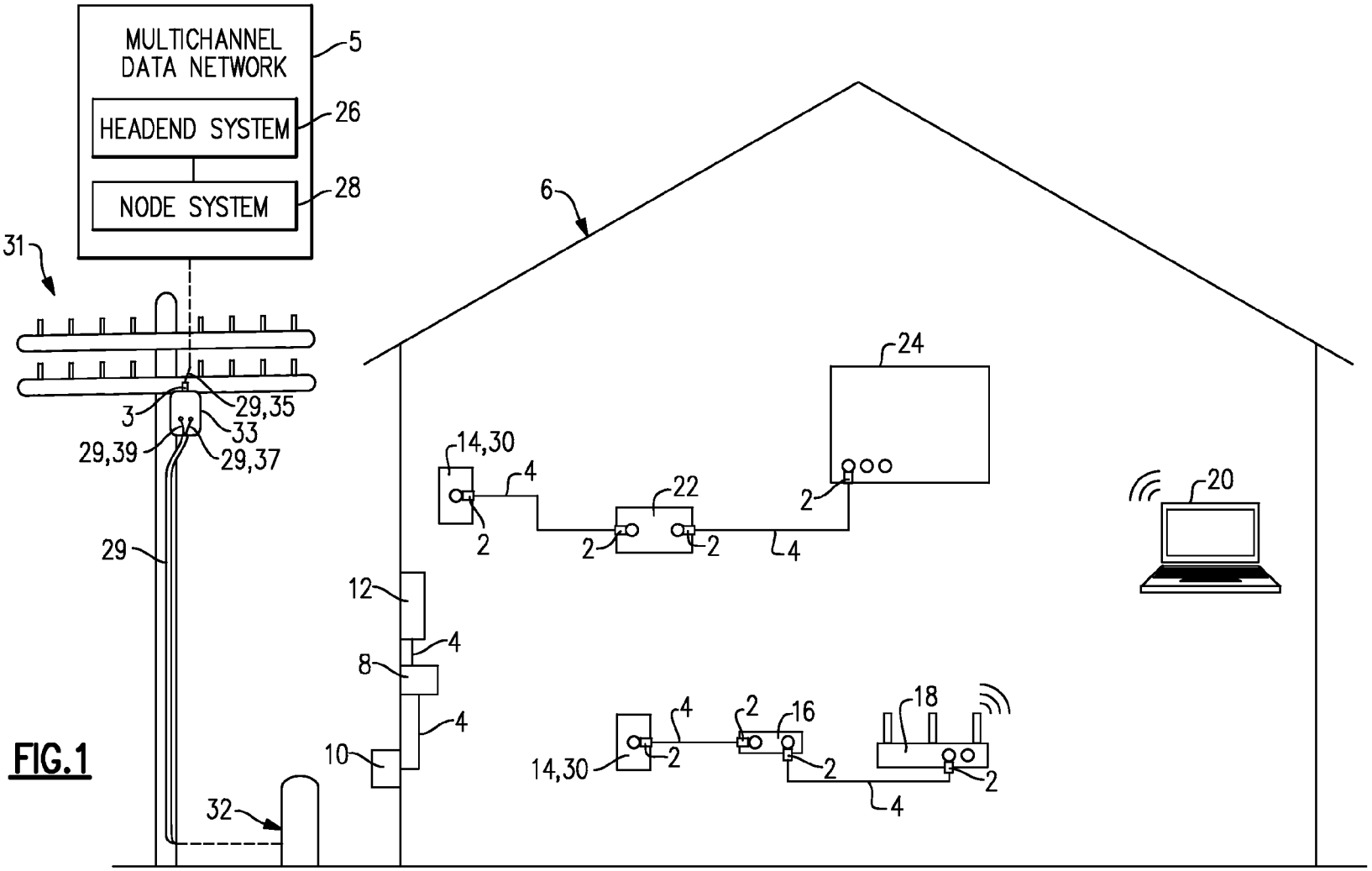
FIG. 1 is a schematic diagram illustrating an environment coupled to a multichannel data network.

Referring to FIG. 1, cable connectors 2 and 3 enable the exchange of data signals between a broadband network or multichannel data network 5, and various devices within a home, building, venue or other environment 6. For example, the environment's devices can include: (a) a point of entry ("PoE") filter 8 operatively coupled to an outdoor cable junction device 10; (b) one or more signal splitters within a service panel 12 which distributes the data service to interface ports 14 of various rooms or parts of the environment 6; (c) a modem 16 which modulates radio frequency ("RF") signals to generate digital signals to operate a wireless router 18; (d) an Internet accessible device, such as a mobile phone or computer 20, wirelessly coupled to the wireless router 18; and (e) a set-top unit 22 coupled to a television ("TV") 24. In one embodiment, the set-top unit 22, typically supplied by the data provider (e.g., the cable TV company), includes a TV tuner and a digital adapter for High Definition TV.

In one distribution method, the data service provider operates a headend facility or headend system 26 coupled to a plurality of optical node facilities or node systems, such as node system 28. The data service provider operates the node systems as well as the headend system 26. The headend system 26 multiplexes the TV channels, producing light beam pulses which travel through optical fiber trunklines. The optical fiber trunklines extend to optical node facilities in local communities, such as node system 28. The node system 28 translates the light pulse signals to RF electrical signals.

In one embodiment, a drop line coaxial cable or weather-protected or weatherized coaxial cable 29 is connected to the headend facility 26 or node facility 28 of the service provider. In the example shown, the weatherized coaxial cable 29 is routed to a standing structure, such as utility pole 31. A splitter or entry junction device 33 is mounted to, or hung from, the utility pole 31. In the illustrated example, the entry junction device 33 includes an input data port or input tap for receiving a hardline connector or pin-type connector 3. The entry junction box device 33 also includes a plurality of output data ports within its weatherized housing. It should be appreciated that such a junction device can include any suitable number of input data ports and output data ports.

The end of the weatherized coaxial cable 35 is attached to a hardline connector or pin-type connector 3, which has a protruding pin insertable into a female interface data port of the junction device 33. The ends of the weatherized coaxial cables 37 and 39 are each attached to one of the connectors 2 described below. In this way, the connectors 2 and 3 electrically couple the cables 35, 37 and 39 to the junction device 33.

In one embodiment, the pin-type connector 3 has a male shape which is insertable into the applicable female input tap or female input data port of the junction device 33. The two female output ports of the junction device 33 are female-shaped in that they define a central hole configured to receive, and connect to, the inner conductors of the connectors 2.

In one embodiment, each input tap or input data port of the entry junction device 33 has an internally threaded wall configured to be threadably engaged with one of the pin-type connectors 3. The network 5 is operable to distribute signals through the weatherized coaxial cable 35 to the junction device 33, and then through the pin-type connector 3. The junction device 33 splits the signals to the pin-type connectors 2, weatherized by an entry box enclosure, to transmit the signals through the cables 37 and 39, down to the distribution box 32 described below.

In another distribution method, the data service provider operates a series of satellites. The service provider installs an outdoor antenna or satellite dish at the environment 6. The data service provider connects a coaxial cable to the satellite dish. The coaxial cable distributes the RF signals or channels of data into the environment 6.

In one embodiment, the multichannel data network 5 includes a CATV network operable to process and distribute different RF signals or channels of signals for a variety of services, including, but not limited to, TV, Internet and voice communication by phone. For TV service, each unique radio frequency or channel is associated with a different TV channel. The set-top unit 22 converts the radio frequencies to a digital format for delivery to the TV. Through the data network 5, the service provider can distribute a variety of types of data, including, but not limited to, TV programs including on-demand videos, Internet service including wireless or WiFi Internet service, voice data distributed through digital phone service or Voice Over Internet Protocol (VoIP) phone service, Internet Protocol TV ("IPTV") data streams, multimedia content, audio data, music, radio and other types of data.

In one embodiment, the multichannel data network 5 is operatively coupled to a multimedia home entertainment network serving the environment 6. In one example, such multimedia home entertainment network is the Multimedia over Coax Alliance ("MoCA") network. The MoCA network increases the freedom of access to the data network 5 at various rooms and locations within the environment 6. The MoCA network, in one embodiment, operates on cables 4 within the environment 6 at frequencies in the range 1125 MHz to 1675 MHz. MoCA compatible devices can form a private network inside the environment 6.

In one embodiment, the MoCA network includes a plurality of network-connected devices, including, but not limited to: (a) passive devices, such as the PoE filter 8, internal filters, diplexers, traps, line conditioners and signal splitters; and (b) active devices, such as amplifiers. The PoE filter 8 provides security against the unauthorized leakage of a user's signal or network service to an unauthorized party or non-serviced environment. Other devices, such as line conditioners, are operable to adjust the incoming signals for better quality of service. For example, if the signal levels sent to the set-top box 22 do not meet designated flatness requirements, a line conditioner can adjust the signal level to meet such requirement.

In one embodiment, the modem 16 includes a monitoring module. The monitoring module continuously or periodically monitors the signals within the MoCA network. Based on this monitoring, the modem 16 can report data or information back to the headend system 26. Depending upon the embodiment, the reported information can relate to network problems, device problems, service usage or other events.

At different points in the network 5, cables 4 and 29 can be located indoors, outdoors, underground, within conduits, above ground mounted to poles, on the sides of buildings and within enclosures of various types and configurations. Cables 29 and 4 can also be mounted to, or installed within, mobile environments, such as land, air and sea vehicles.

As described above, the data service provider uses coaxial cables 29 and 4 to distribute the data to the environment 6. The environment 6 has an array of coaxial cables 4 at different locations. The connectors 2 are attachable to the coaxial cables 4. The cables 4, through use of the connectors 2, are connectable to various communication interfaces within the environment 6, such as the female interface ports 14 illustrated in FIGS. 1-2. In the examples shown, female interface ports 14 are incorporated into: (a) a signal splitter within an outdoor cable service or distribution box 32 which distributes data service to multiple homes or environments 6 close to each other; (b) a signal splitter within the outdoor cable junction box or cable junction device 10 which distributes the data service into the environment 6; (c) the set-top unit 22; (d) the TV 24; (e) wall-mounted jacks, such as a wall plate; and (f) the router 18.

Figure 2:
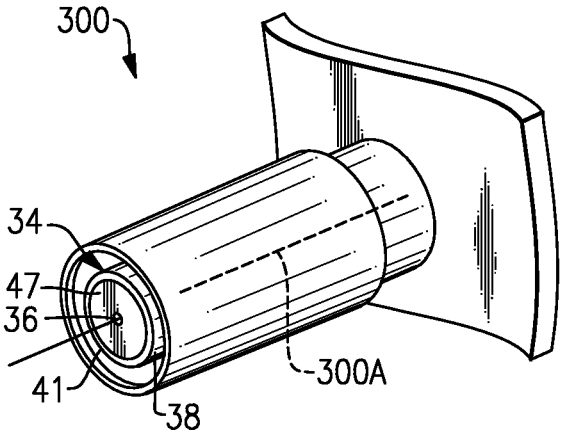
FIG. 2 is an isometric view of one embodiment of a port accessory which is configured to be operatively coupled to the multichannel data network.
Figure 4:
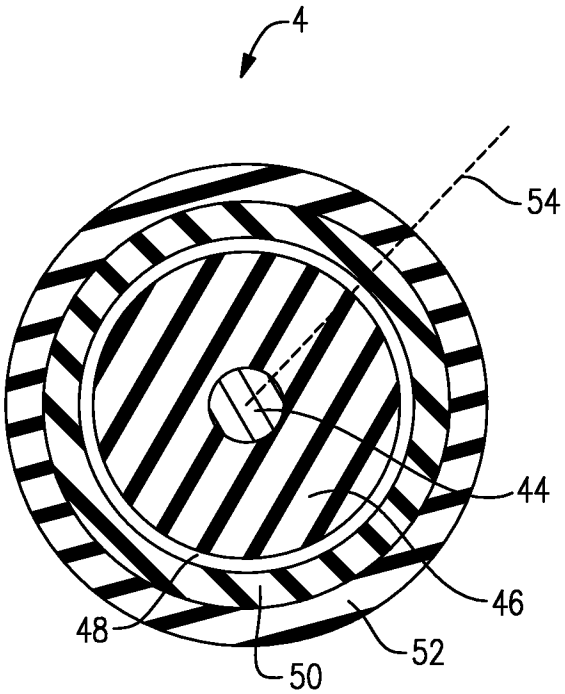
FIG. 4 is a cross-sectional view of the cable, taken substantially along line 4-4 of FIG. 3.

In one embodiment shown in FIG. 2, a female interface port 34 includes (a) an inner, cylindrical wall 36 defining a central hole configured to receive an electrical contact, wire or conductor (not shown) positioned within the central hole; (b) a conductive outer surface 38; (c) a conductive region along a front face 41; and (d) a dielectric or insulation material 47. As described further below, in one embodiment, a port accessory 300 is configured to be attached to, or integrated with, the interface port. The port accessory 300 is operable to adapt or convert the interface port 34 to a slide-compatible port 300 that is compatible with a slide-on or push-pull connector attachment method instead of a screw-on connector attachment method. The slide-compatible port 300 slidably receives and engages the post axially along a central elongate axis 300A and includes an actuating collar to rapidly release the post from the slide-compatible port 300. The slide-compatible port 300, as described in greater detail below, enables a user to push the connector 2, 3 or a modified attachment assembly onto the interface port 34 to establish an electrical connection.

It should be understood that the port body 34 can be operatively coupled to, or incorporated into, a device 40 which can include, for example, a cable splitter of a distribution box 32, outdoor cable junction box 10 or service panel 12; a set-top unit 22; a TV 24; a wall plate; a modem 16; a router 18; or the junction device 33.

During installation, the installer couples a cable 4 to an interface port 14 by axially pushing the connector assembly onto the female interface port 34. The female interface port 34 receives an attachment fitting of the connector assembly which establishes an electrical connection between the cable 4 and the electrical contact of the female interface port 34.

After installation, the connector assembly is often exposed to various forces. For example, there may be tension in the cable 4 as it stretches from one device 40 to another device 40, imposing a steady, tensile load on the connector assembly. A user might occasionally move, pull or push on a cable 4 from time to time, causing forces on the connector assembly. Alternatively, a user might swivel or shift the position of a TV 24, causing bending loads on the connector assembly. As described below, the connector assembly is structured to maintain a suitable level of electrical connectivity despite such forces.

Cable

Referring to FIGS. 3-6, the coaxial cable 4 extends along a cable axis or a longitudinal axis 42. In one embodiment, the cable 4 includes: (a) an elongated center conductor or inner conductor 44; (b) an elongated insulator 46 coaxially surrounding the inner conductor 44; (c) an elongated, conductive foil layer 48 coaxially surrounding the insulator 46; (d) an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in one embodiment, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

Figure 3:
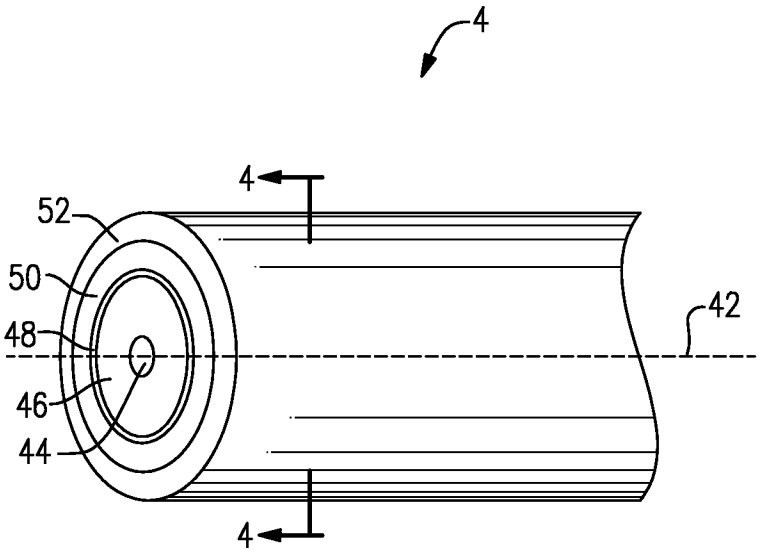
FIG. 3 is a broken-away isometric view of one embodiment of a cable which is configured to be operatively coupled to the multichannel data network.

In the embodiment illustrated in FIG. 3, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, as described below, the connector assembly electrically grounds the outer conductor 50 of the coaxial cable 4. When the inner conductor 44 and external electronic devices generate magnetic fields, the grounded outer conductor 50 sends the excess charges to ground. In this way, the outer conductor 50 cancels all, substantially all or a suitable amount of the potentially interfering magnetic fields. Therefore, there is less, or an insignificant, disruption of the data signals running through inner conductor 44. Also, there is less, or an insignificant, disruption of the operation of external electronic devices near the cable 4.

In such embodiment, the cable 4 has two electrical grounding paths. The first grounding path runs from the inner conductor 44 to ground. The second grounding path runs from the outer conductor 50 to ground.

The conductive foil layer 48, in one embodiment, is an additional, tubular conductor which provides additional shielding of the magnetic fields. In one embodiment, the foil layer 48 includes a flexible foil tape or laminate adhered to the insulator 46, assuming the tubular shape of the insulator 46. The combination of the foil layer 48 and the outer conductor 50 can suitably block undesirable radiation or signal noise from leaving the cable 4. Such combination can also suitably block undesirable radiation or signal noise from entering the cable 4. This can result in an additional decrease in disruption of data communications through the cable 4 as well as an additional decrease in interference with external devices, such as nearby cables and components of other operating electronic devices.

In one embodiment, the jacket 52 has a protective characteristic, guarding the cable's internal components from damage. The jacket 52 also has an electrical insulation characteristic. In one embodiment, the jacket 52 is compressible along the radial line 54 and is flexible along the longitudinal axis 42. The jacket 52 is constructed of a suitable, flexible material such as polyvinyl chloride (PVC) or rubber. In one embodiment, the jacket 52 has a lead-free formulation including black-colored PVC and a sunlight resistant additive or sunlight resistant chemical structure.

Figure 5:
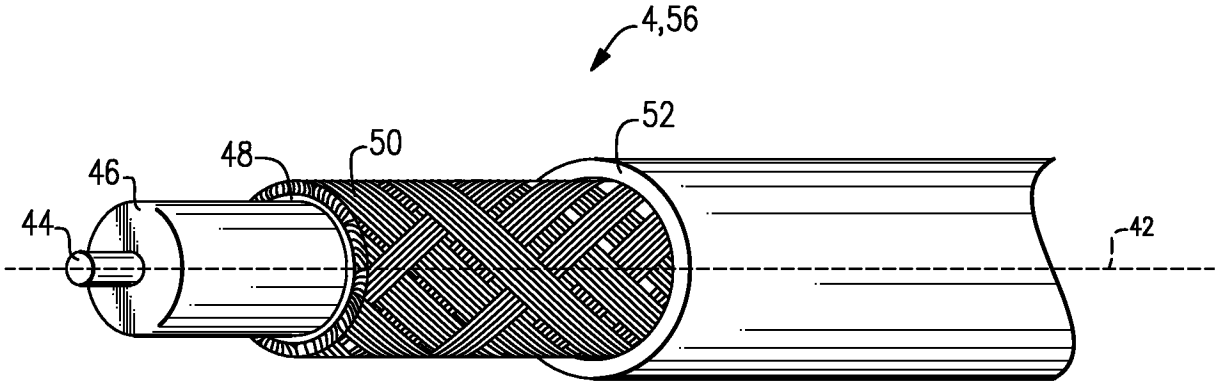
FIG. 5 is a broken-away isometric view of one embodiment of a cable which is configured to be operatively coupled to the multichannel data network, illustrating a three-stepped configuration of a prepared end of the cable.
Figure 6:
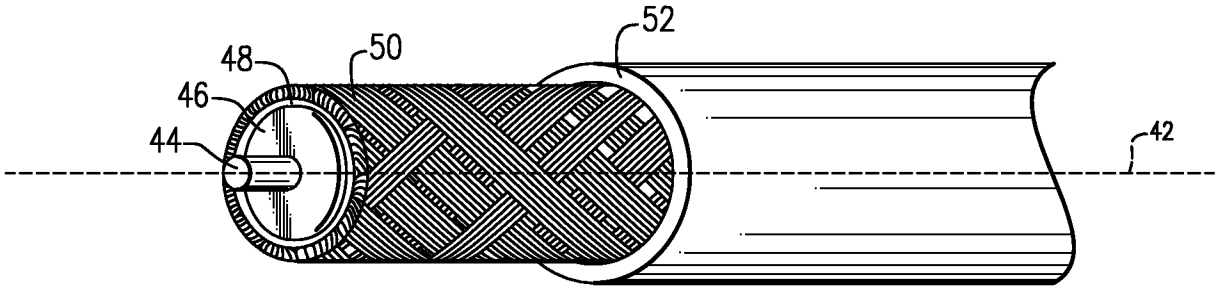
FIG. 6 is a broken-away isometric view of one embodiment of a cable which is configured to be operatively coupled to the multichannel data network, illustrating a two-stepped configuration of a prepared end of the cable.

Referring to FIGS. 5-6, in one embodiment an installer or preparer prepares a terminal end 56 of the cable 4 so that it can be mechanically connected to the connector assembly. To do so, the preparer removes or strips away differently sized portions of the jacket 52, outer conductor 50, foil 48 and insulator 46 so as to expose the side walls of the jacket 52, outer conductor 50, foil layer 48 and insulator 46 in a stepped or staggered fashion. In the example shown in FIG. 5, the prepared end 56 has a three step-shaped configuration. In the example shown in FIG. 6, the prepared end 58 has a two step-shaped configuration. The preparer can use cable preparation pliers or a cable stripping tool to remove such portions of the cable 4. At this point, the cable 4 is ready to be connected to the connector assembly.

Figure 7:
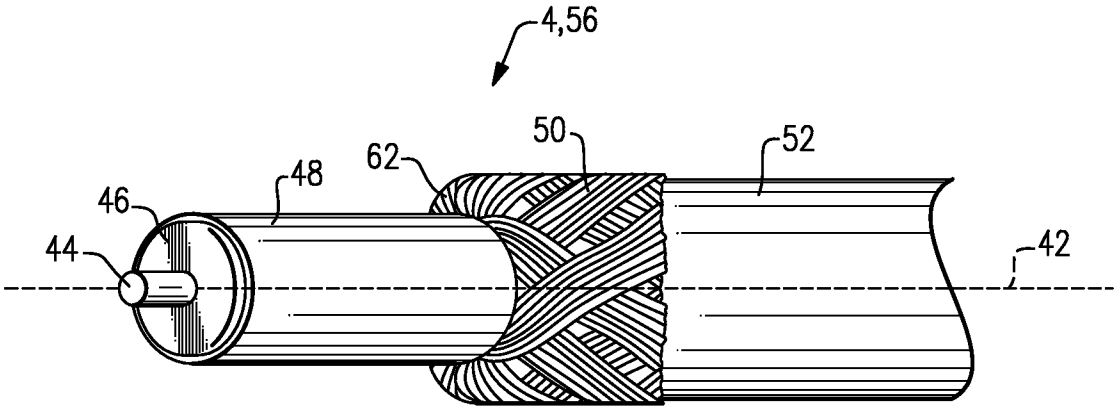
FIG. 7 is a broken-away isometric view of one embodiment of a cable which is configured to be operatively coupled to the multichannel data network, illustrating the folded-back, braided outer conductor of a prepared end of the cable.

In one embodiment illustrated in FIG. 7, the installer or preparer performs a folding process to prepare the cable 4 for connection to connector assembly. In the example illustrated, the preparer folds the braided outer conductor 50 backward onto the jacket 52. As a result, the folded section 60 is oriented inside out. The bend or fold 62 is adjacent to the foil layer 48 as shown. Certain embodiments of the connector assembly include a tubular post. In such embodiments, this folding process can facilitate the insertion of such post in between the braided outer conductor 50 and the foil layer 48.

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50 and the jacket 52 can vary based upon parameters corresponding to broadband communication standards or installation equipment.

Figure 8:
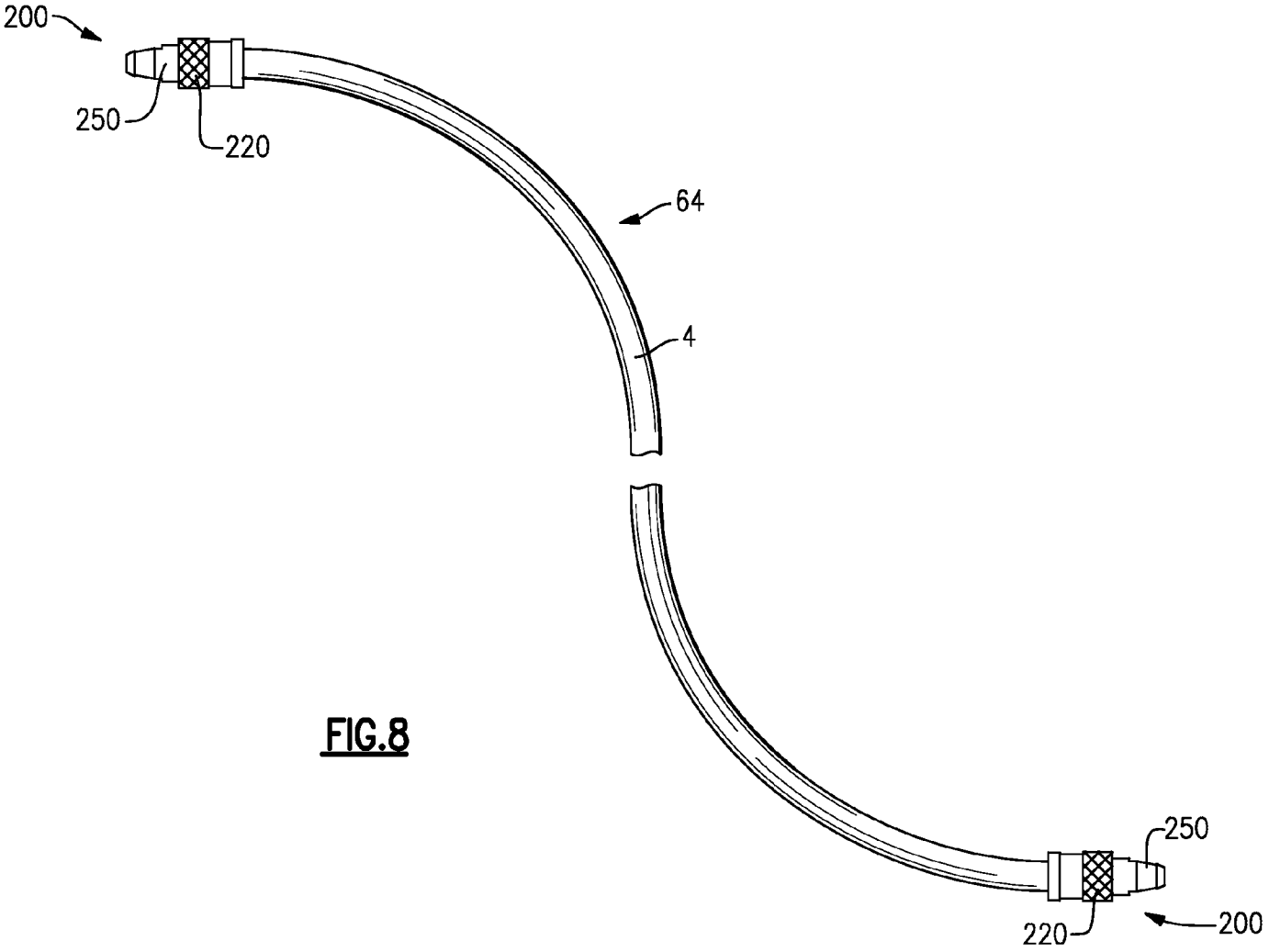
FIG. 8 is a top view of one embodiment of a cable jumper or cable assembly which is configured to be operatively coupled to the multichannel data network.

In one embodiment illustrated in FIG. 8, a cable jumper or cable assembly 64 includes an attachment assembly 200 at each end of a central cable 4. In this embodiment, each attachment assembly 200 includes: a connector body 220 and a post 250, which is electrically grounded to the outer conductor 50 of the coaxial cable 4. Preassembled cable jumpers or cable assemblies 64 can facilitate the installation of cables 4 for various purposes.

In one embodiment the weatherized coaxial cable 29, illustrated in FIG. 1, has the same structure, configuration and components as coaxial cable 4 except that the weatherized coaxial cable 29 includes additional weather protective and durability enhancement characteristics. These characteristics enable the weatherized coaxial cable 29 to withstand greater forces and degradation factors caused by outdoor exposure to weather.

Connector Assembly and Port Accessory

Figure 9:
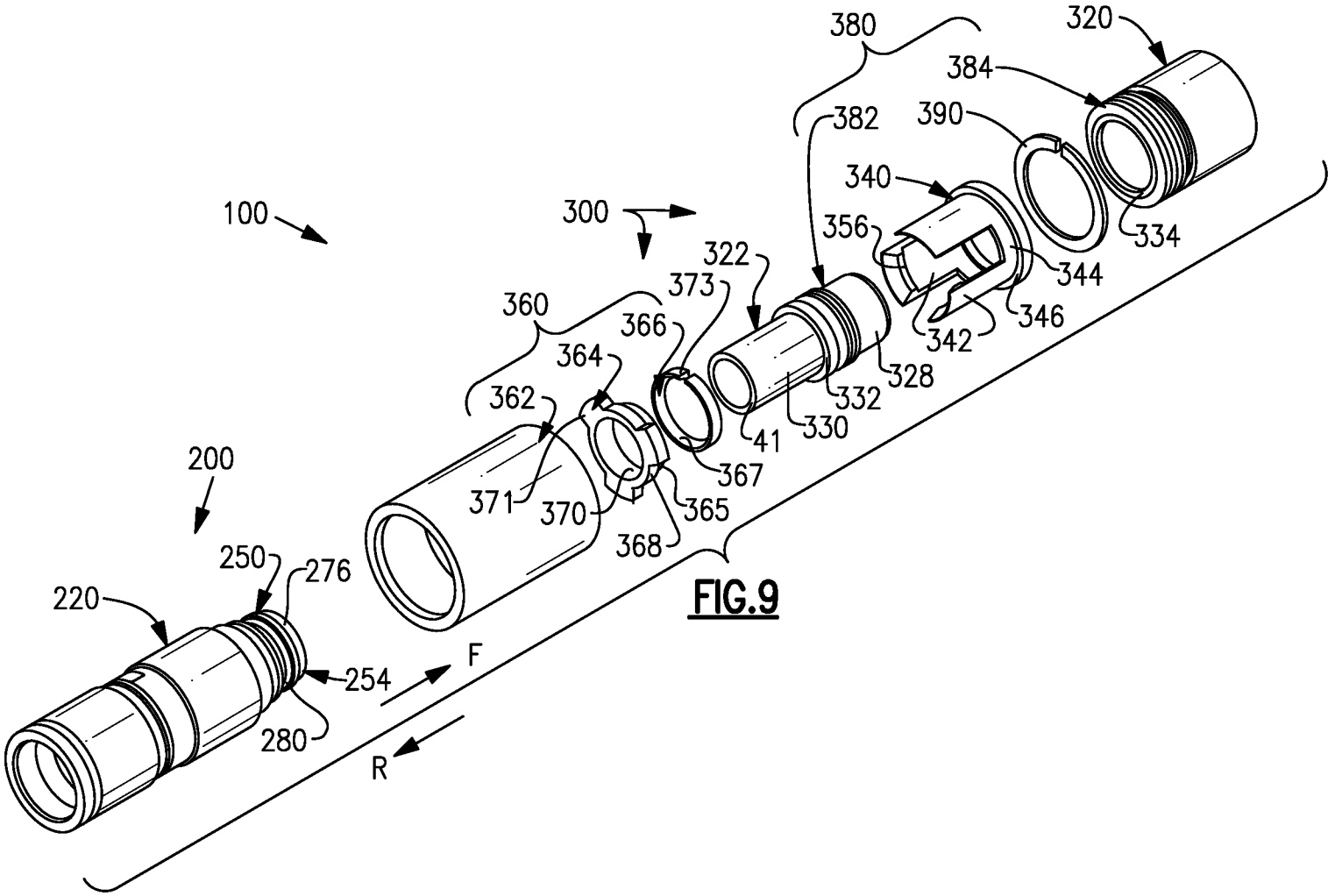
FIG. 9 depicts an exploded perspective view of an attachment assembly and a port accessory which collectively define a connector assembly in accordance with one embodiment of the present disclosure.
Figure 10:
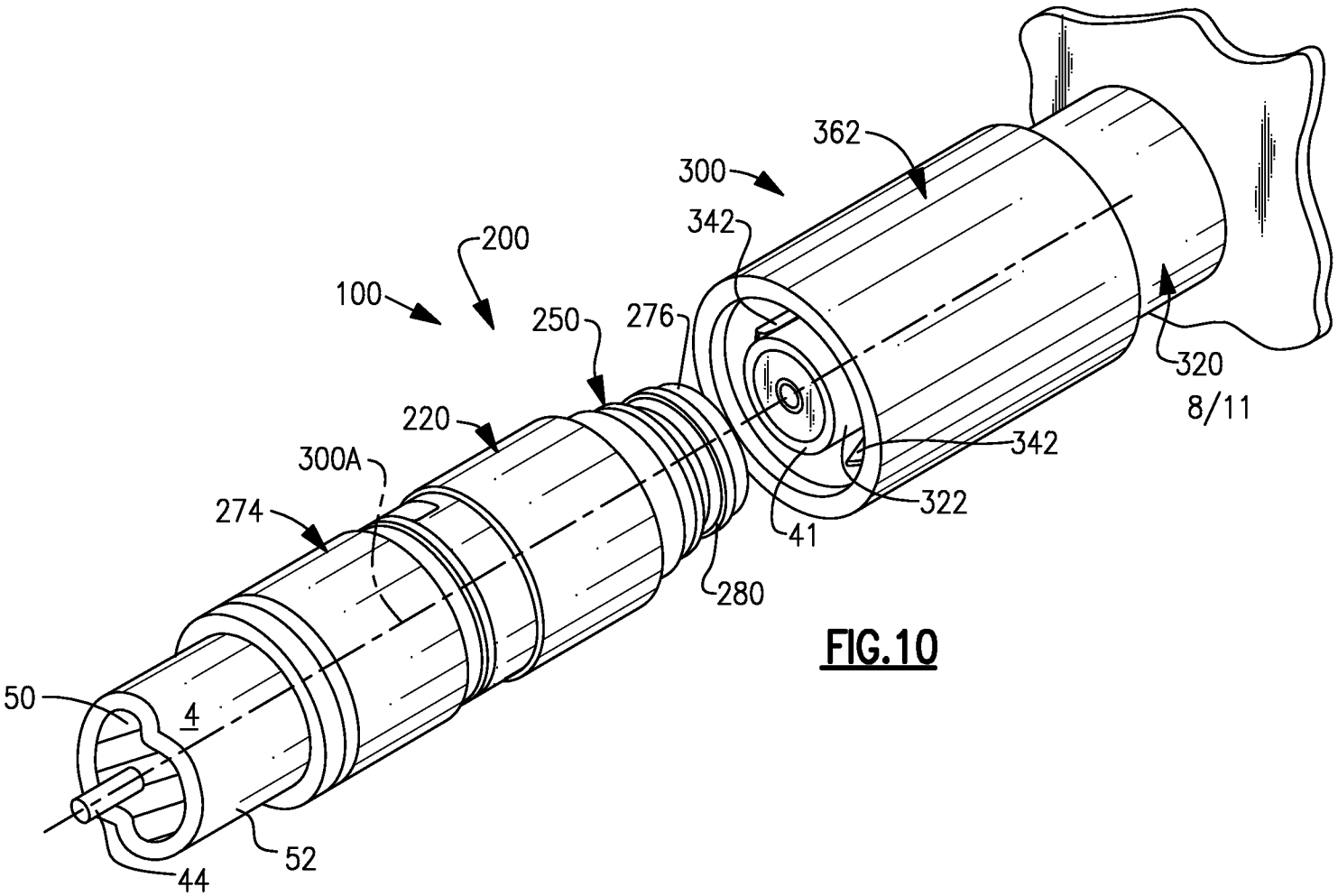
FIG. 10 is a partially exploded perspective view of one embodiment of the connector assembly wherein a post and connector body of the attachment assembly are attached to a coaxial cable and the port accessory is assembled in combination with an RF device.
Figure 11:
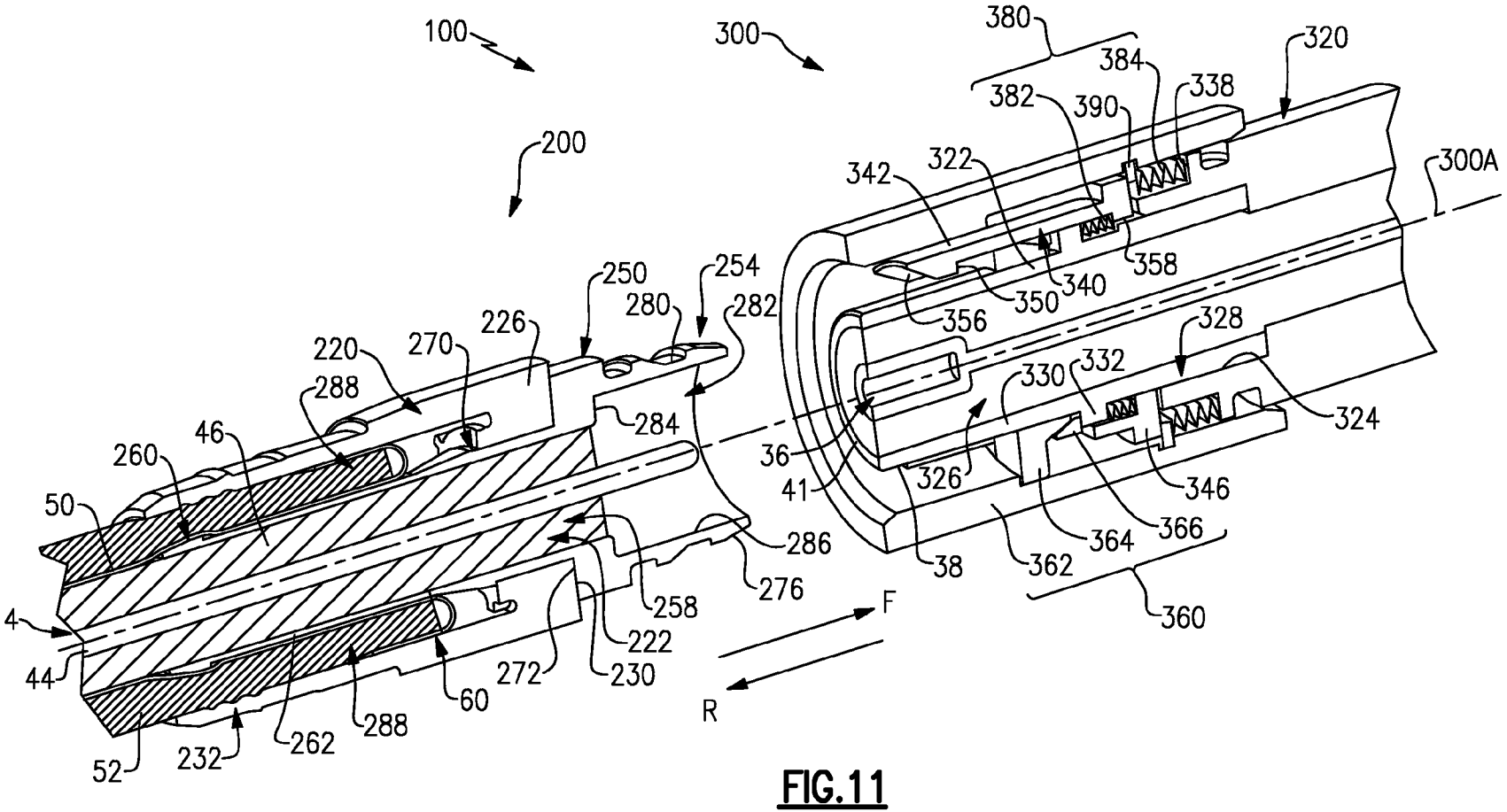
FIG. 11 is a cross-sectional view taken substantially along line 11-11 of FIG. 10 depicting the relevant internal components of the connector assembly including a post engager, an actuator assembly and a spring assembly.

As mentioned in the preceding paragraphs and referring to FIGS. 9-11, it is desirable to electrically shield the RF signal, i.e., the signal carried by the inner conductor 44 (FIG. 11), to prevent ingress and/or egress of RF energy into or from the coaxial cable 4. Proper shielding abates interference from neighboring RF networks and prevents cross-talk with other RF communication systems. Such shielding is commonly effected by a conductive sheathing, web or braided material over the signal carrying conductor 44. The shielding material is electrically grounded to carry the interfering or stray RF signals away from the signal-carrying conductor 44. A break, gap or passage which allows RF energy to escape can result in leakage which can be harmful to other networks and communication systems.

For example, RF leakage from an RF device can distort or degrade the television image of a cable network subscriber located in close proximity to the source of the RF leakage. In yet another example, the collective RF leakage emanating from the set-top boxes of a residential high-rise building can create hazards to commercial aircraft flying over the building. The source of RF leakage in the building may be a collection of loose fitting connections between the set-top boxes and the respective coaxial cable. If the RF levels are too high, the responsible governmental authorities, e.g., the Federal Aviation Authority (FAA), can impose large monetary fines against the responsible service provider. Such fines may continue until the service provider remedies the problem by properly shielding the RF devices.

The connector assembly 100, attachment assembly 200, and slide-compatible port 300 of the present disclosure remedy the grounding and RF performance difficulties by: (i) providing a relatively simple, push-pull attachment method, as opposed to a screw-on method, to electrically connect and ground the coaxial cable 4, (ii) maintaining a corrective or constant bias force to counteract the forces pulling the cable 4 away from an interface port in the event that, for example, the attachment assembly 200 temporarily decouples from the slide-compatible port 300, i.e., should the coaxial cable 4 be inadvertently pulled away from an RF device, and (iii) providing an RF shield over areas of potential RF leakage or loss.

In the described embodiment depicted in FIGS. 9-11, the connector assembly 100 maintains grounding contact with the outer conductor 50 (FIG. 11) of the coaxial cable 4 independent of axial separation of the attachment assembly 200, i.e., when assembled, from the slide-compatible port 300. The following paragraphs briefly describe the principal elements of the connector assembly 100 and the structural/functional interaction between the elements. Thereafter, each element will be described in greater detail.

For the purposes of establishing direction and orientation of the various components, an arrow F defines a forward direction, or a direction defining the movement of the attachment assembly 200 when attaching the coaxial cable 4 to the slide-compatible port 300. Likewise, an arrow R defines a rearward direction, or a direction defining the displacement of the attachment assembly 200 when releasing or detaching the coaxial cable 4 to the slide-compatible port 300.

In the described embodiment, the connector assembly 100 includes the attachment assembly 200 and the slide-compatible port 300. The attachment assembly 200 is axially received by the slide-compatible port 300 along an elongate axis 300A and includes a connector body 220 and a post 250 disposed within and coaxial with the connector body 220. The connector body 220 receives and engages the outer conductor 50 of the coaxial cable 4. The post 250 includes an attachment fitting 254 at a forward end, an annular barb 260 (FIG. 11) at an aft end, and an elongate sleeve 262 disposed therebetween and connecting the annular barb 260 to the attachment fitting 254.

The slide-compatible port 300 comprises: (i) a port body 320 including a body extender or adapter 322, (ii) a post engager 340 having a plurality of axial retention fingers 342 operative to engage and retain the post 250 in a first operating mode, (iii) an actuator 360 including an actuating collar 362 and a driver assembly 364, 366 (best shown in FIG. 9) operative to release the post 250 in a second operating mode, and (iv) a spring assembly 380 configured to axially bias the post 250 against the port body 320 in the first operating mode to facilitate maintenance of an electrical ground path and mitigate ingress and egress of RF energy.

The connector body 220 is configured to receive the coaxial cable 4 and at least a portion of the post 250 through a central bore 222 (FIG. 11). A portion of the central bore 222 is defined by an inwardly facing flange 226 at a forward end of the connector body 220. Structurally, the inwardly facing flange 226 centers and supports a medial portion 270 of the post 250 while a front face 230 of the flange 226 engages an inner shoulder 272 of the post 250 to axially position the post 250 within the connector body 220. In the described embodiment, a fastener 274 (FIG. 10) attaches to an aft end 232 of the connector body 220 to deform and compress the connector body 220 against the outer jacket 52 (FIGS. 10 and 11) of the coaxial cable 4. Deformation of the aft end 232 of connector body 220 causes the outer jacket 52 to frictionally and mechanically engage the annular barb 260 of the post 250 thereby coupling the coaxial cable 4 to the connector body 220 and the post 250.

The post 250 defines an aperture 258, coaxial with the central bore 222 of the connector body 220, which is configured to receive the inner conductor 44 of the coaxial cable 4. Furthermore, the post 250 is configured to engage the outer conductor 50. The elongate sleeve 262 of the post 250 and connector body 220 define an annular cavity 288 for accepting the folded section 60 of the braided outer conductor 50. By inserting the folded portion 60 within the annular cavity 288, the braided outer conductor 50 envelops the elongate sleeve 262 providing a large surface area for the transfer of RF energy across the conductive surfaces, i.e., the surfaces of the outer conductor 50 and the sleeve 262. In the described embodiment, the connector body 220 may be fabricated from metals or other conductive materials that facilitate the manufacture of a rigid body. In addition, the connector body 220 may also be composed of non-conductive materials such as polymers or composites that produce similar structural properties. A combination of both conductive and non-conductive materials may also be employed. The post 250, may also be fabricated from metals, metal alloys, or a combination of metal and composite materials to fabricate a structure with the desired structural integrity and stiffness. Conductive metals useful to fabricate the post 250 include copper, zinc, bronze, aluminum, iron, steel, etc.

Figure 12:
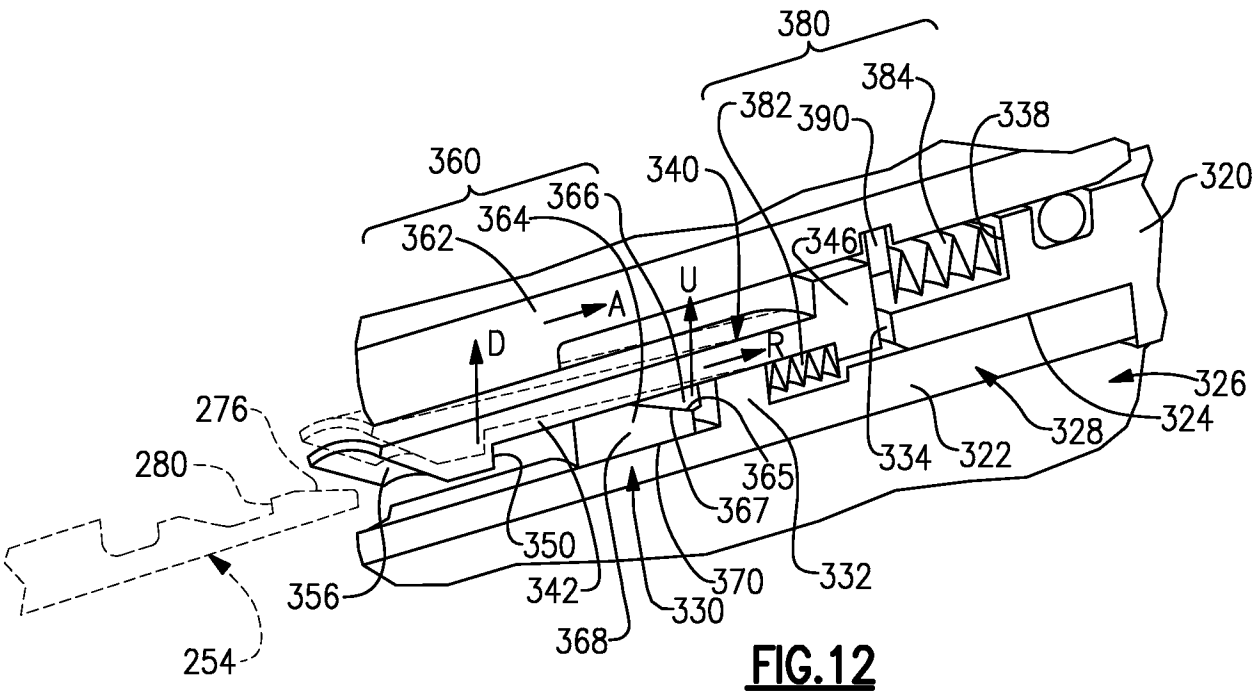
FIG. 12 is an enlarged cross-sectional view of one embodiment of the post engager, an actuator assembly and a spring assembly depicting the alternate modes of operation wherein the attachment assembly engages the post engager in a first operating mode and the actuator assembly is activated in a second operating mode.

Before describing the slide-compatible port 300, it will be useful to briefly describe the annular or attachment fitting 254 of the post 250. In FIGS. 11 and 12, the attachment fitting 254 of the post 250 facilitates axial engagement and release of the signal-carrying inner conductor 50 into the port 300. Functionally, the attachment fitting 254 of the post 250 is uniquely configured to facilitate rapid coupling in one operating mode and quick release in a second operating mode. The slide-compatible port 300 engages the attachment fitting 254 in one operating mode and releases the attachment fitting 254 in another operating mode. Moreover, the slide-compatible port 300 biases the attachment fitting 254 of the post 250 toward the slide-compatible port 300 to maintain a highly reliable ground path while providing improved RF performance (discussed in greater detail when describing the port).

The attachment fitting 254 of the post 250 includes a conical or inclined surface 276 defining a positive slope relative to the elongate axis 300A of the slide-compatible port 300. Further, the fitting 254 includes a ring-shaped retention lip 280 aft of the inclined surface 276. The inclined surface 276 is operative to engage the inclined surface 356 of each axial retention finger 342 to spread each axial retention finger 342 in a radially outward direction D (FIG. 12). The inclined surfaces 276, 356 are spread immediately prior to engagement of the axial retention finger 342 with the ring-shaped retention lip 280. As such, the ring-shaped retention lip 280 receives and engages the post engager 340 to retain the post 250 relative to the slide-compatible port 300 in the first operating mode.

The attachment fitting 254 also includes a cylindrical cavity or recess 282 for receiving the port body 320. The cylindrical recess 282 of the attachment fitting 254 includes an internal grounding shoulder 284 in a plane normal to the elongate axis 300A and a cylindrical grounding surface 286 coaxial with the axis 300A. When the post 250 engages the slide-compatible port 300, i.e., when the attachment fitting 254 is retained by the post engager 340, the spring assembly 380 draws the attachment fitting 254 and the internal grounding shoulder 284 against the front face 41 of the body adapter 322. That is, a continuous or constant bias force is applied to the ring-shaped retention lip 280 by the post engager 340 as the spring assembly 380 biases the axial retention fingers 342 inwardly toward the port body 320. As such, the bias force ensures that a positive electrical ground is maintained between the post 250 and the slide-compatible port 300 while the connector assembly 100 is attached to the slide-compatible port 300.

The body adapter 322 may be threaded, or press fit, into a bore 324 of the port body 320. While the body adapter 322 is separate from an aft portion of the port body 320, it should be appreciated that the body adapter 322 may be integral with the port body 320, hence, the terms are used interchangeably herein. In the described embodiment, the port body 320 and the body adapter 322 are separate principally to facilitate assembly/disassembly.

In the described embodiment, the body adapter 322 defines a aperture 326 for receiving the signal-carrying inner conductor 44 of the coaxial cable 4 along the elongate axis 300A of the slide-compatible port 300. Furthermore, the adapter 322 is electrically grounded to the outer conductor 50 of the coaxial cable 4 which, as discussed in the preceding paragraph, by inserting the body adapter 322 into the cylindrical recess 282 of the attachment fitting 254. In addition to the electrical ground path established between the front face 41 of the body adapter 322 and the internal grounding shoulder 284, the electrical ground path between the post 250 and the slide-compatible port 300 may be augmented by contact of the cylindrical grounding surface 286 with the outer cylindrical surface 38 of the body adapter 322.

In the described embodiment, the body adapter 322 is cylindrically-shaped body and includes first and second portions 328, 330 separated by a ridge, wall or protrusion 332 extending radially from the cylindrical body. The first portion 328 is received within the bore 324 of the body adapter 322 such that a shoulder, step or stop surface 334 is produced between the port body 320 and the body adapter 322. The stop surface 334 limits the axial travel of the post engager 340 to facilitate actuation and release of the post engager 340 during the second operating mode. Similar to the post 250, the port body 320 and body adapter 322 may be fabricated from metals or other conductive materials facilitating the manufacture of a rigid body. Conductive metals useful to fabricate the port body 320 and body adapter 322 include copper, zinc, bronze, aluminum, iron, steel, etc. Alternatively, a combination of both conductive and non-conductive materials may also be employed. Therefore, the port body 320 and body adapter 322 may be fabricated from a combination of metals, thermoset composites and/or thermoplastic composite materials. Composite materials may include graphite, boron, or fiberglass reinforcing fibers disposed in a binding matrix.

The post engager 340 is configured to engage/disengage the ring-shaped retention lip 280 of the post 250 in each of the two operating modes. More specifically, the post engager 340 may include three equiangular axial retention fingers 342 integrated at one end with a cylindrical sleeve 344 having a bi-directional flange 346 extends from, and is integrated with, the sleeve 344. Furthermore, the bi-directional flange 346 defines an aperture 358 for receiving the first portion 328 of the body adapter 322. When assembled the bi-directional flange 346 is supported by and slides along the cylindrical outer surface of the body adapter 322 and each axial retention finger 342 extends axially across the ridge 332 from the first portion 328 to the second portion 330 of the body adapter 322.

Figure 13:
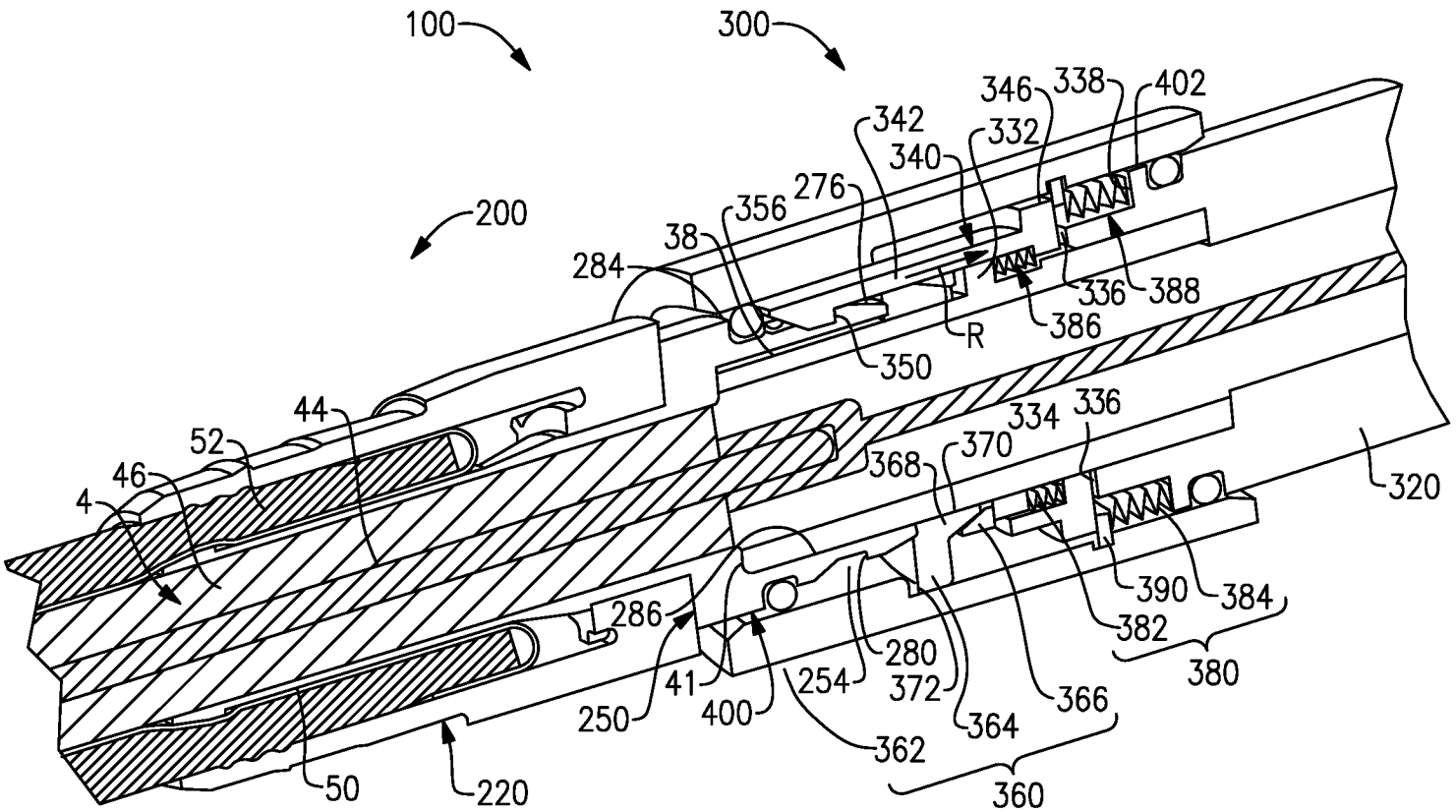
FIG. 13 is the cross-sectional view shown in FIG. 11 wherein the attachment assembly engages the port in the first operating mode.

In FIGS. 12 and 13, each axial retention finger 342 comprises an arcuate shoulder 350 proximal a forward end of the axial retention finger 342, opposite the bi-directional flange 346 at the rearward end of the post engager 340. The inclined surface 356 is immediately forward of the shoulder 350 and defines a negative slope such that when engaging the positively sloping inclined surface 276 of the attachment fitting 254, the axial retention fingers 342 are spread apart or displaced upwardly in a radial direction D (FIG. 12). Inasmuch as each axial retention finger 342 is essentially a cantilever spring, the arcuate shoulders 350 of each finger 342 are biased radially downward in response to an upward force. Consequently, when the post 250 is fully received by the port body 320, the axial retention fingers 342 bias the arcuate shoulders 350 downwardly into engagement with the ring-shaped retention lip 280 of the attachment fitting 254.

In addition to a downward bias, the axial retention fingers 342 are biased in a rearward direction R to maintain a positive spring force or bias on the post 250, i.e., to bring the internal grounding shoulder 284 into engagement with the front face 41 of the body adapter 322. This will be discussed in subsequent paragraphs when describing the spring assembly 380.

The actuator 360 is configured to translate axially along the elongate axis 300A to release the post engager 340 from the ring-shaped retention lip 280 of the post 250 in the second operating mode. In the described embodiment, the actuating collar 362 is coaxial with the body adapter 322 and is supported by the port body 320 and the second portion of the body adapter 322 via the driver assembly 364, 366.

In FIGS. 9, 12 and 13, the driver assembly 364, 366 includes a frustum driver 364 having an outwardly facing conical drive surface 365 and an C-shaped expansion ring 366 having an inwardly facing conical surface 367 complimenting the outwardly facing conical drive surface 365 of the driver 364. The frustum driver 364 includes a conical ring 368 having aperture 370 for receiving the second portion 330 of the body adapter 322 and a plurality of radial projections 371 (FIG. 9) extending outwardly from the conical ring 368. Each radial projection 371 extends between adjacent fingers 342 of the post engager 340 and engages a shoulder 372 formed internally of the actuating collar 362.

The expansion ring 366 abuts the radially projecting ridge 332 of the body adapter 322 along one side thereof and the underside of each axial retention finger 342 along the outwardly facing circumference 373 (best shown in FIG. 9) of the expansion ring 366. Operationally, the expansion ring 366 expands outwardly in response to the axial displacement of the actuating collar 362 to radially displace and disengage the post engager 340 from the ring-shaped retention lip 280 of the attachment fitting 254. More specifically, axial displacement of the actuating collar 362 effects axial translation of the driver 364 between each of the axial retention fingers 342. The axial translation of the driver 364 causes (i) the conical drive surface 365 to engage the complementary conical surface 367 of the ring 366, and (ii) radial expansion of the ring 366. Radial expansion of the ring 366 effects radial displacement of each axial retention finger 342 (shown in dashed lines in FIG. 12), which, in turn, causes the arcuate shoulder 350 of each finger 342 to disengage the ring-shaped retention lip 280 of the post 250.

The actuating collar 362 and axial retention fingers 342 may be fabricated from metals or other conductive materials facilitating the manufacture of a rigid body. Conductive metals useful to fabricate the actuating collar 362 and axial retention fingers 342 include copper, zinc, bronze, aluminum, iron, steel, etc. Alternatively, a combination of both conductive and non-conductive materials may also be employed the fabricate the collar 362 and retention fingers 342.

The spring assembly 380 is configured to axially bias the post 250 the first operating mode to maintain a positive biasing force on the post 250. As mentioned earlier, the positive biasing force serves to maintain an electrical ground path between the post 250 and the body adapter 322. More specifically, the spring assembly 380 comprises first and second biasing elements 382, 384 operably coupled to the post engager 340. The first biasing element interposes the bi-directional flange 346 of the post engager 340 and the radially projecting ridge 332 of the post body adapter 322. In the described embodiment, the first biasing element 382 is disposed within a cavity 386 defined by the first portion 328 of the body adapter 322, the radially projecting rigid thereof, the cylindrical sleeve portion of the post engager and the lower portion of the bi-directional flange, a surface of the lower portion opposing the radially projecting ridge 332 of the body adapter 322. The second biasing element 384 engages a C-shaped retention ring 390 which, in turn engages the bi-directional flange 346 of the post engager 340 and the internal shoulder, step or stop 334 of the port body 320. In the described embodiment, the second biasing element 384 is disposed within a cavity 388 defined by the port body 320, the actuating collar 362 and an upper portion of the bi-directional flange 346, i.e., a surface of the upper portion opposing the forwardly facing shoulder 338 of the port body 320.

The first spring biasing element 382, therefore, biases the axial retention fingers 342 of the post engager 340 rearwardly in a direction R, in the first operating mode, to maintain a positive rearward bias on the post 250. Accordingly, any force tending to pull the post away from the slide-compatible port 300, i.e., a force tending to break the ground path, is counteracted by the rearward biasing force of the first spring biasing element 382. The second spring biasing element 384 biases the actuating collar 362 forwardly in the second operating mode, i.e., during release of the post engager 340 from the ring-shaped retention lip 280 of the post 250. Consequently, once the actuating collar 362 is displaced rearwardly, along arrow A (FIG. 12), against the forward biasing force of the second spring biasing element 384, the actuating collar 362 and driver assembly 364, 366 are returned to their original axial position.

In addition to biasing the actuating collar 362, the second spring biasing element 384 may interact with the first spring biasing element 382 to: (i) produce a neutral bias between the first and second axial positions, e.g., between the stop surface 336 and the ridge 332 of the body adapter 322, and (ii) cause the bi-directional flange 346 to float between the first and second axial positions. As such, in addition to moving the actuating collar 362 rearwardly to disengage the post engager 340, a user or operator may move the collar 362 and the axial retention fingers 342 of the post engager 340 forwardly to facilitate engagement of the axial retention fingers 342. Further, once the actuating collar 362 is released, the spring assembly 380 seeks a neutral bias position to maintain a positive force on the post 250, i.e., a force urging the post 250 toward and against the slide-compatible port 300.

The connector assembly 100, therefore, enables rapid engagement and disengagement of the attachment assembly 200. In a first operating mode, the attachment assembly 200 is thrust axially into the slide-compatible port 300 such that the inner conductor 44 aligns with the receiving aperture 36. In FIG. 12, the attachment fitting 254 is shown in dashed lines immediately prior to engagement with the slide-compatible port 300. As the attachment assembly 200 is pushed axially into the port, the positively-sloped inclined surface 276 of the attachment fitting 254 engages the negatively-sloped inclined surface 356 of each axial retention finger 342. As the attachment fitting 254 engages the fingers 342, the fingers 342 are displaced in a radial upward direction U to allow the arcuate shoulders 350 to engage the ring-shaped retention lip 280 of the attachment fitting 254. More specifically, each axial retention finger 342 produces a downward bias to engage the arcuate shoulders 350 with the retention lip 280.

In the second operating mode, the connector assembly 100 facilitates rapid disengagement by axially displacing the collar 362 rearwardly against the spring bias produced by the second biasing element 384. The collar 362 engages the driver 364 in an axial direction A which, in turn displaces the expansion ring 366 in a radial direction D. The expansion ring 366 engages the underside of each axial retention finger 342 to lift each finger 342 in an upward direction U. With each finger biased upwardly, the attachment assembly 200 may be removed by sliding or pulling the attachment assembly 200 away from the slide-compatible port 300.

In the first operating mode, the connector assembly produces a constant axial bias force on the attachment fitting to bring the attachment fitting 254 into engagement with the port body adapter 322, and more particularly, with the conductive front face 41 thereof. More specifically, the first biasing element 382 is configured to impose a rearward force on each of the axial retention fingers 342. That is, the first biasing element 382 imposes a force in the direction of arrow R (see FIG.

12) to maintain a constant axial bias on the ring-shaped retention lip 280 of the attachment fitting 254. The constant axial bias counteracts forces tending to pull the attachment assembly from the port, hence maintaining a reliable grounding contact therebetween.

It will be appreciated that the connector assembly 100 also provides several electrical ground paths from the braided outer conductor 50 to the port body 320. A primary ground path may be created from the outer conductor 50 to the sleeve 262 of the post 250, to the front face 41 of the port body 320 through the internal grounding shoulder 284 of the attachment fitting 254, and, to a ground source from the slide-compatible port 300. A secondary ground path may be created from the outer conductor 50 to the sleeve 262, to the ring-shaped retention lip 280, to the axial retention fingers 342, to the body adapter 322 through the bi-directional flange 346 of the post engager 340, and to a ground source from the slide-compatible port 300. A tertiary ground path may be created from the outer conductor 50 to the sleeve 256, across a first mating interface 400 between the forward end of the post 250, across the collar 362 to a second mating interface 402, across the second mating interface 402 to the port body 320, through the body adapter 322, and to a ground source from the slide-compatible port 300.

With respect to the latter, the connector assembly 100 may enhance RF performance by providing complete coverage over the connector assembly 100. That is, the combination of the actuating collar 362 and the first and second mating interfaces 400, 402 provide a three-hundred and sixty degree (360) electrical shield over the connecting components of the connector assembly 100.

As mentioned in the preceding paragraphs and referring to FIGS. 9-11, it is desirable to electrically shield the RF signal, i.e., the signal carried by the inner conductor 44 (FIG. 11), to prevent ingress and/or egress of RF energy into or from the coaxial cable 4. Proper shielding abates interference from neighboring RF networks and prevents cross-talk with other RF communication systems. Such shielding is commonly effected by a conductive sheathing, web or braided material over the signal carrying conductor 44. The shielding material is electrically grounded to carry the interfering or stray RF signals away from the signal-carrying conductor 44. Any break, gap or passage which allows RF energy to escape can result in leakage which can be harmful to other networks and communication systems.

For example, RF leakage from an RF device can distort or degrade the television image of a cable network subscriber located in close proximity to the source of the RF leakage. In yet another example, the collective RF leakage emanating from the set-top boxes of a residential high-rise building can create hazards to commercial aircraft flying over the building. The source of RF leakage in the building may be a collection of loose fitting connections between the set-top boxes and the respective coaxial cable. If the RF levels are too high, the responsible governmental authorities, e.g., the Federal Aviation Authority (FAA), can impose large monetary fines against the responsible service provider. Such fines may continue until the service provider remedies the problem by properly shielding the RF devices.

The connector assembly 100, attachment assembly 200, and slide-compatible port 300 of the present disclosure remedy the grounding and RF performance difficulties by: (i) eliminating a threaded coupler typically employed to electrically ground the coaxial cable 4, (ii) maintaining a corrective bias force in the event that the attachment assembly 200 temporarily decouples from the slide-compatible port 300, i.e., should the coaxial cable 4 be inadvertently pulled away from an RF device, and (iii) providing an RF shield over areas of potential RF leakage or loss.

In the described embodiment depicted in FIGS. 9-11, the connector assembly 100 maintains grounding contact with the outer conductor 50 (FIG. 11) of the coaxial cable 4 independent of axial separation of the fitting 200, i.e., when assembled, from the slide-compatible port 300. The following paragraphs briefly describe the principal elements of the connector assembly 100 and the structural/functional interaction between the elements. Thereafter, each element will be described in greater detail.

For the purposes of establishing direction and orientation of the various components, an arrow F defines a forward direction, or a direction defining the movement of the attachment assembly 200 when attaching the coaxial cable 4 to the slide-compatible port 300. Likewise, an arrow R defines a rearward direction, or a direction defining the displacement of the attachment assembly 200 when releasing or detaching the coaxial cable 4 to the slide-compatible port 300.

In the described embodiment, the connector assembly 100 includes the attachment assembly 200 and the slide-compatible port 300. The attachment assembly 200 is axially received by the slide-compatible port 300 along an elongate axis 300A and includes a connector body 220 and a post 250 disposed within and coaxial with the connector body 220. The connector body 220 receives and engages the outer conductor 50 of the coaxial cable 4. The post 250 includes an attachment fitting 254 at a forward end, an annular barb 260 (FIG. 11) at an aft end, and an elongate sleeve 262 disposed therebetween and connecting the annular barb 260 to the attachment fitting 254.

The slide-compatible port 300 comprises: (i) a port body 320 including a body extender or adapter 322, (ii) a post engager 340 having a plurality of axial retention fingers 342 operative to engage and retain the post 250 in a first operating mode, (iii) an actuator 360 including an actuating collar 362 and a driver assembly 364, 366 (best shown in FIG. 9) operative to release the post 250 in a second operating mode, and (iv) a spring assembly 380 configured to axially bias the post 250 against the port body 320 in the first operating mode to facilitate maintenance of an electrical ground path and mitigate ingress and egress of RF energy.

The connector body 220 is configured to receive the coaxial cable 4 and at least a portion of the post 250 through a central bore 222 (FIG. 11). A portion of the central bore 222 is defined by an inwardly facing flange 226 at a forward end of the connector body 220. Structurally, the inwardly facing flange 226 centers and supports a medial portion 270 of the post 250 while a front face 230 of the flange 226 engages an inner shoulder 272 of the post 250 to axially position the post 250 within the connector body 220. In the described embodiment, a fastener 274 (FIGS. 9 and 10) attaches to an aft end 232 of the connector body 220 to deform and compress the connector body 220 against the outer jacket 52 (FIGS. 10 and 11) of the coaxial cable 4. Deformation of the aft end 232 of connector body 220 causes the outer jacket 52 to frictionally and mechanically engage the annular barb 260 of the post 250 thereby coupling the coaxial cable 4 to the connector body 220 and the post 250.

The post 250 defines an aperture 258, coaxial with the central bore 222 of the connector body 220, which is configured to receive the inner conductor 44 of the coaxial cable 4. Furthermore, the post 250 is configured to engage the outer conductor 50. The elongate sleeve 262 of the post 250 and connector body 220 define an annular cavity 288 for accepting the folded section 60 of the braided outer conductor 50. By inserting the folded portion 60 within the annular cavity 288, the braided outer conductor 50 envelops the elongate sleeve 262 providing a large surface area for the transfer of RF energy across the conductive surfaces, i.e., the surfaces of the outer conductor 50 and the sleeve 262. In the described embodiment, the connector body 220 may be fabricated from metals or other conductive materials that facilitate the manufacture of a rigid body. In addition, the connector body 220 may also be composed of non-conductive materials such as polymers or composites that produce similar structural properties. A combination of both conductive and non-conductive materials may also be employed. The post 250, may also be fabricated from metals, metal alloys, or a combination of metal and composite materials to fabricate a structure with the desired structural integrity and stiffness. Conductive metals useful to fabricate the post 250 include copper, zinc, bronze, aluminum, iron, steel, etc.

Before describing the slide-compatible port 300, it will be useful to briefly describe the annular or attachment fitting 254 of the post 250. In FIGS. 11 and 12, the attachment fitting 254 of the post 250 facilitates axial engagement and release of the signal-carrying inner conductor 50 into the port 300. Functionally, the attachment fitting 254 of the post 250 is uniquely configured to facilitate rapid coupling in one operating mode and quick release in a second operating mode. The slide-compatible port 300 engages the attachment fitting 254 in one operating mode and releases the attachment fitting 254 in another operating mode. Moreover, the slide-compatible port 300 biases the attachment fitting 254 of the post 250 toward the slide-compatible port 300 to maintain a highly reliable ground path while providing improved RF performance (discussed in greater detail when describing the port).

The attachment fitting 254 of the post 250 includes a conical or inclined surface 276 defining a positive slope relative to the elongate axis 300A of the slide-compatible port 300. Further, the fitting 254 includes a ring-shaped retention lip 280 aft of the inclined surface 276. The inclined surface 276 is operative to engage the inclined surface 356 of each axial retention finger 342 to spread each axial retention finger 342 in a radially outward direction D (FIG. 12). The inclined surfaces 276, 356 are spread immediately prior to engagement of the axial retention finger 342 with the ring-shaped retention lip 280. As such, the ring-shaped retention lip 280 receives and engages the post engager 340 to retain the post 250 relative to the slide-compatible port 300 in the first operating mode.

The attachment fitting 254 also includes a cylindrical cavity or recess 282 for receiving the port body 320. The cylindrical recess 282 of the attachment fitting 254 includes an internal grounding shoulder 284 in a plane normal to the elongate axis 300A and a cylindrical grounding surface 286 coaxial with the axis 300A. When the post 250 engages the slide-compatible port 300, i.e., when the attachment fitting 254 is retained by the post engager 340, the spring assembly 380 draws the attachment fitting 250 and the internal grounding shoulder 284 against the front face 41 of the body adapter 322. That is, a continuous or constant bias force is applied to the ring-shaped retention lip 280 by the post engager 340 as the spring assembly 380 biases the axial retention fingers 342 inwardly toward the port body 320. As such, the bias force ensures that a positive electrical ground is maintained between the post 250 and the slide-compatible port 300.

The body adapter 322 may be threaded, or press fit, into a bore 324 of the port body 320. While the body adapter 322 is separate from an aft portion of the port body 320, it should be appreciated that the body adapter 322 may be integral with the port body 320, hence, the terms are used interchangeably herein. In the described embodiment, the port body 320 and the body adapter 322 are separate principally to facilitate assembly/disassembly.

In the described embodiment, the body adapter 322 defines a aperture 326 for receiving the signal-carrying inner conductor 44 of the coaxial cable 4 along the elongate axis 300A of the slide-compatible port 300. Furthermore, the adapter 322 is electrically grounded to the outer conductor 50 of the coaxial cable 4 which, as discussed in the preceding paragraph, by inserting the body adapter 322 into the cylindrical recess 282 of the attachment fitting 254. In addition to the electrical ground path established between the front face 41 of the body adapter 322 and the internal grounding shoulder 284, the electrical ground path between the post 250 and the slide-compatible port 300 may be augmented by contact of the cylindrical sidewall surface 286 with the outer cylindrical surface 38 of the body adapter 322.

In the described embodiment, the body adapter 322 is cylindrically-shaped body and includes first and second portions 328, 330 separated by a ridge, wall or protrusion 332 extending radially from the cylindrical body. The first portion 328 is received within the bore 324 of the body adapter 322 such that a shoulder, step or stop surface 334 is produced between the port body 320 and the body adapter 322. The stop surface 334 limits the axial travel of the post engager 340 to facilitate actuation and release of the post engager 340 during the second operating mode. Similar to the post 250, the port body 320 and body adapter 322 may be fabricated from metals or other conductive materials facilitating the manufacture of a rigid body. Conductive metals useful to fabricate the port body 320 and body adapter 322 include copper, zinc, bronze, aluminum, iron, steel, etc. Alternatively, a combination of both conductive and non-conductive materials may also be employed. Therefore, the port body 320 and body adapter 322 may be fabricated from a combination of metals, thermoset composites and/or thermoplastic composite materials. Composite materials may include graphite, boron, or fiberglass reinforcing fibers disposed in a binding matrix.

The post engager 340 is configured to engage/disengage the ring-shaped retention lip 280 of the post 250 in each of the two operating modes. More specifically, the post engager 340 may include three equiangular axial retention fingers 342 integrated at one end with a cylindrical sleeve 344 having a bi-directional flange 346 extends from, and is integrated with, the sleeve 344. Furthermore, the bi-directional flange 346 defines an aperture 358 for receiving the first portion 328 of the body adapter 322. When assembled the bi-directional flange 346 is supported by and slides along the cylindrical outer surface 336 of the body adapter 322 and each axial retention finger 342 extends axially across the ridge 332 from the first portion 328 to the second portion 330 of the body adapter 322.

In FIGS. 12 and 13, each axial retention finger 342 comprises an arcuate shoulder 350 proximal a forward end of the axial retention finger 342, opposite the bi-directional flange 346 at the rearward end of the post engager 340. The inclined surface 356 is immediately forward of the shoulder 350 and defines a negative slope such that when engaging the positively sloping inclined surface 276 of the attachment fitting 254, the axial retention fingers 342 are spread apart or displaced upwardly in a radial direction D (FIG. 12). Inasmuch as each axial retention finger 342 is essentially a cantilever spring, the arcuate shoulders 350 of each finger 342 are biased radially downward in response to an upward force. Consequently, when the post 250 is fully received by the port body 320, the axial retention fingers 342 bias the arcuate shoulders 350 downwardly into engagement with the ring-shaped retention lip 280 of the attachment fitting 254.

In addition to a downward bias, the axial retention fingers 342 are biased in a rearward direction R to maintain a positive spring force or bias on the post 250, i.e., to bring the internal grounding shoulder 284 into engagement with the front face 41 of the body adapter. This will be discussed in subsequent paragraphs when describing the spring assembly 380.

The actuator 360 is configured to translate axially along the elongate axis 300A to release the post engager 340 from the ring-shaped retention lip 280 of the post 250 in the second operating mode. In the described embodiment, the actuating collar 362 is coaxial with the body adapter 322 and is supported by the port body 320 and the second portion of the body adapter 330 via the driver assembly 364, 366.

In FIGS. 9, 12 and 13, the driver assembly 364, 366 includes a frustum driver 364 having an outwardly facing conical drive surface 365 and an C-shaped expansion ring 366 having an inwardly facing conical surface 367 complimenting the outwardly facing conical drive surface 365 of the driver 364. The frustum driver 364 includes a conical ring 368 having aperture 370 for receiving the second portion 330 of the body adapter 322 and a plurality of radial projections 371 (FIG. 9) extending outwardly from the conical ring 368. Each radial projection 371 extends between adjacent fingers 342 of the post engager 340 and engages a shoulder 372 formed internally of the actuating collar 362.

The expansion ring 364 abuts the radially projecting ridge 332 of the body adapter 322 along one side thereof and the underside of each axial retention finger 342 along the outwardly facing circumference 373 (best shown in FIG. 9) of the expansion ring 364. Operationally, the expansion ring 364 expands outwardly in response to the axial displacement of the actuating collar 362 to radially displace and disengage the post engager 340 from the ring-shaped retention lip 280 of the attachment fitting 254. More specifically, axial displacement of the actuating collar 362 effects axial translation of the driver 364 between each of the axial retention fingers 342. The axial translation of the driver 364 causes (i) the conical drive surface 365 to engage the complementary conical surface 367 of the ring 366, and (ii) radial expansion of the ring 364. Radial expansion of the ring 364 effects radial displacement of each axial retention finger 342 (shown in dashed lines in FIG. 12), which, in turn, causes the arcuate shoulder 350 of each finger 342 to disengage the ring-shaped retention lip 280 of the post 250.

The actuating collar 362 and axial retention fingers 342 may be fabricated from metals or other conductive materials facilitating the manufacture of a rigid body. Conductive metals useful to fabricate the actuating collar 362 and axial retention fingers 342 include copper, zinc, bronze, aluminum, iron, steel, etc. Alternatively, a combination of both conductive and non-conductive materials may also be employed the fabricate the collar 362 and retention fingers 342.

The spring assembly 380 is configured to axially bias the post 250 the first operating mode to maintain a positive biasing force on the post 250. As mentioned earlier, the positive biasing force serves to maintain an electrical ground path between the post 250 and the body adapter 322. More specifically, the spring assembly 380 comprises first and second biasing elements 382, 384 operably coupled to the post engager 320. The first biasing element interposes the bi-directional flange 346 of the post engager 340 and the radially projecting ridge 332 of the post body adapter 322. In the described embodiment, the first biasing element 382 is disposed within a cavity 386 defined by the first portion 324 of the body adapter 322, the radially projecting rigid thereof, the cylindrical sleeve portion of the post engager and the lower portion of the bi-directional flange, a surface of the lower portion opposing the radially projecting ridge 332 of the body adapter 322. The second biasing element 384 engages a C-shaped retention ring 390 which, in turn engages the bi-directional flange 346 of the post engager 340 and the internal shoulder, step or stop 336 of the post body 320. In the described embodiment, the second biasing element 384 is disposed within a cavity 388 defined by the port body 320, the actuating collar 362 and an upper portion of the bi-directional flange 346, i.e., a surface of the upper portion opposing the forwardly facing shoulder 332 of the port body 320.

The first spring biasing element 382, therefore, biases the axial retention fingers 342 of the post engager 340 rearwardly in a direction R, in the first operating mode, to maintain a positive rearward bias on the post 250. Accordingly, any force tending to pull the post away from the slide-compatible port 300, i.e., a force tending to break the ground path, is counteracted by the rearward biasing force of the first spring biasing element 382. The second spring biasing element 384 biases the actuating collar 362 forwardly in the second operating mode, i.e., during release of the post engager 340 from the ring-shaped retention lip 280 of the post 250. Consequently, once the actuating collar 362 is displaced rearwardly, along arrow A (FIG. 12), against the forward biasing force of the second spring biasing element 384, the actuating collar 362 and driver assembly 364, 366 are returned to their original axial position.

In addition to biasing the actuating collar 362, the second spring biasing element 384 may interact with the first spring biasing element 382 to: (i) produce a neutral bias between the first and second axial positions, e.g., between the stop surface 336 and the ridge 332 of the body adapter 322, and (ii) cause the bi-directional flange 346 to float between the first and second axial positions. As such, in addition to moving the actuating collar 362 rearwardly to disengage the post engager 340, a user or operator may move the collar 362 and the axial retention fingers 342 of the post engager 340 forwardly to facilitate engagement of the axial retention fingers 342. Further, once the actuating collar 362 is released, the spring assembly 380 seeks a neutral bias position to maintain a positive force on the post 250, i.e., a force urging the post 250 toward and against the slide-compatible port 300.

The connector assembly 100, therefore, enables rapid and convenient, slide-based engagement and disengagement of the attachment assembly 200. In a first operating mode, the attachment assembly 200 is slid or thrust axially into the slide-compatible port 300 such that the inner conductor 44 aligns with the receiving aperture 36. In FIG. 12, the attachment fitting 254 is shown in dashed lines immediately prior to engagement with the slide-compatible port 300. As the attachment assembly 200 is pushed axially into the port, the positively-sloped inclined surface 276 of the attachment fitting 254 engages the negatively-sloped inclined surface 356 of each axial retention finger 342. As the attachment fitting 254 engages the fingers 342, the fingers 342 are displaced in a radial upward direction U to allow the arcuate shoulders 350 to engage the ring-shaped retention lip 280 of the attachment fitting 254. More specifically, each axial retention finger 342 produces a downward bias to engage the arcuate shoulders 350 with the retention lip 280.

In the second operating mode, the connector assembly 100 facilitates rapid disengagement by axially displacing the collar 362 rearwardly against the spring bias produced by the second biasing element 384. The collar 362 engages the driver 364 in an axial direction A which, in turn displaces the expansion ring 366 in a radial direction D. The expansion ring 366 engages the underside of each axial retention finger 342 to lift each finger 342 in an upward direction U. With each finger biased upwardly, the attachment fitting 200 may be removed by sliding or pulling the fitting 200 away from the slide-compatible port 300.

In the first operating mode, the connector assembly produces a constant axial bias force on the attachment fitting to bring the attachment fitting 254 into engagement with the port body adapter 322, and more particularly, with the conductive front face 41 thereof. More specifically, the first biasing element 382 is configured to impose a rearward force on each of the axial retention fingers 342. That is, the first biasing element 382 imposes a force in the direction of arrow R (see FIG. 12) to maintain a constant axial bias on the ring-shaped retention lip 280 of the attachment fitting 254. The constant axial bias counteracts forces tending to pull the attachment assembly from the port, hence maintaining a reliable grounding contact therebetween.

It will be appreciated that the connector assembly 100 also provides several electrical ground paths from the braided outer conductor 50 to the port body 320. A primary ground path may be created from the outer conductor 50 to the sleeve 262 of the post 250, to the front face 41 of the port body 320 through the internal grounding shoulder 284 of the attachment fitting 254, and, to a ground source from the slide-compatible port 300. A secondary ground path may be created from the outer conductor 50 to the sleeve 262, to the ring-shaped retention lip 280, to the axial retention fingers 342, to the body adapter 322 through the bi-directional flange 346 of the post engager 340, and to a ground source from the slide-compatible port 300. A tertiary ground path may be created from the outer conductor 50 to the sleeve 256, across a first mating interface 400 between the forward end of the post 250, across the collar 362 to a second mating interface 402, across the second mating interface 402 to the port body 320, through the body adapter 322, and to a ground source from the slide-compatible port 300.

With respect to the latter, the connector assembly 100 may enhance RF performance by providing complete coverage over the connector assembly 100. That is, the combination of the actuating collar 362 and the first and second mating interfaces 400, 402 provide a three-hundred and sixty degree (360) electrical shield over the connecting components of the connector assembly 100.

While the body adapter 322 has been described as being a press fit threaded onto the body port 320, it should be appreciated that the port accessory 300 may be a separate assembly which may be friction fit onto a threaded or non-threaded port such as those described earlier in connection with FIG. 1. That is, the port body adapter 322, port engager 340, actuator 360 and spring assembly 380 may be provided as a separate, stand-alone unit or assembly which is simply slid into or over another port such as the port 34, the port body 320 extending from an RF device, or an RF jack projecting from a wall plate.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A coaxial interface port accessory comprising:

a port body configured to be a portion of an interface port, the port body configured to receive a signal-carrying inner conductor of a coaxial cable along an elongate axis and configured to be electrically grounded to an outer conductor of the coaxial cable, the port body including a body adapter having first and second portions and a ridge separating the first and second portions, the ridge protruding radially from the body adapter;

a post engager configured to receive and engage a post of a coaxial cable connector in a first operating mode, the post engager comprising a cylindrical sleeve and a bi-directional flange integral with, and extending radially from, the sleeve, the bi-directional flange defining an aperture for accepting the second portion of the body adapter and having a plurality of axial retention fingers extending from the sleeve, each axial retention finger extending across the ridge of the body adapter from the second portion to the first portion of the body adapter, each axial retention finger, furthermore, comprising an arcuate shoulder at one end of the axial retention finger and defining a cantilever spring for biasing the arcuate shoulder radially into engagement with a ring-shaped retention lip of the post, the post engager including at least three equiangular axial retention fingers, each having an inclined surface for slideably engaging an inclined surface of the post, the inclined surfaces of the post engager and the inclined surfaces of the post spreading the end of each axial retention finger in a radial direction such that, when the post is fully received within the port body, the axial retention fingers bias the arcuate shoulders of the post engager radially toward the elongate axis and into engagement with the ring-shaped retention lip of the post;

an actuator configured to translate axially along the elongate axis to release the post engager from the ring-shaped retention lip of the post in a second operating mode, the actuator including a collar and a drive assembly coupled to the collar, the collar circumscribing the axial retention fingers and coaxial with the body adapter, the drive assembly releasing the arcuate shoulder of each axial retention finger from engagement with the ring-shaped retention lip of the post in response to axial displacement of the collar, the drive assembly furthermore including a frustum driver defining an outwardly facing conical surface and an expansion ring having a complimentary inwardly facing conical surface, the outwardly facing conical surface of the frustum driver engaging the inwardly facing conical surface of the expansion ring to expand the expansion ring radially outward to lift the axial retention fingers and the respective arcuate shoulders from engagement with the ring-shaped retention lip of the post; and a biasing assembly operably coupled to the post engager and configured to axially bias the post against the port body in the first operating mode to maintain an electrical ground path between the post and the port body, the biasing assembly comprising first and second biasing elements, the first biasing element interposing the post engager and a forwardly facing shoulder of the port body and the second biasing element interposing the post engager and the radially projecting rigid of the port body.

2. A connector assembly comprising:

a post configured to receive an inner conductor of a coaxial cable and further configured to be engaged with an outer conductor of the coaxial cable;

a connector body configured to at least partially receive a first end of the post; and an interface port accessory, the interface port accessory comprising:

a port body configured to receive a second end of the post, the port body being extendable along an axis;

a post engager configured to alternate between first and second operating modes, the post engager configured to engage the second end of the post in the first operating mode;

an actuator configured to translate axially along the axis and to release the post engager from the post in the second operating mode; and a spring assembly operably coupled to the post engager and configured to axially bias the post against the port body during the first operating mode to facilitate an electrical ground path between the port body and the post.

3. The connector assembly of claim 2 wherein the post engager comprises an cylindrical sleeve and a bi-directional flange integral with and extending radially from the cylindrical sleeve, the bi-directional flange having an aperture therein for accepting the port body and a plurality of axial retention fingers extending from the cylindrical sleeve along the elongate axis.

4. The connector assembly of claim 3 wherein each end of the respective axial retention finger comprises an inclined surface for slideably engaging an inclined surface of the post, the inclined surfaces of the post engager and the post spreading the end of each axial retention finger in a radial direction such that, when the post is fully received within the port body, the axial retention fingers bias the arcuate shoulders of the post engager radially into engagement with the ring-shaped retention lip of the post.

5. The connector assembly of claim 2 wherein the spring assembly is operably coupled to the actuator such that axial displacement of the actuator away from the post causes the actuator to disengage the post engager from the post.

6. The connector assembly of claim 2 wherein the actuator includes a collar circumscribing the post engager to produce an electrical shield around the cable connector.

7. The connector assembly of claim 6 wherein the collar mates with the port along a first mating interface at one end of the collar, wherein the collar mates with the post along a second mating interface at the other end of the collar and further comprises an electrical seal interposing each of the first and second mating interfaces.

8. The connector assembly of claim 2 wherein the spring assembly includes first and second biasing elements, wherein the first biasing element interposes the post engager and a forwardly facing shoulder of the port body and the second biasing element interposes the post engager and the radially projecting rigid of the port body.

9. An interface port accessory comprising:

a port body configured to receive a portion of a coaxial cable connector, the port body being extendable along an axis;

a post engager configured to alternate between first and second operating modes, the post engager configured to engage a post of the coaxial cable connector in the first operating mode;

an actuator configured to translate axially along the axis and to release the post engager from the post in the second operating mode; and a spring assembly operably coupled to the post engager and configured to axially bias the post against the port body during the first operating mode to facilitate an electrical ground path between the port body and the post.

10. The interface port accessory of claim 9 wherein the actuator includes a collar circumscribing the post engager to produce an electrical shield around the cable connector.

11. The interface port accessory of claim 9 wherein the post engager comprises an cylindrical sleeve and a bi-directional flange integral with and extending radially from the cylindrical sleeve, the bi-directional flange having an aperture therein for accepting the port body and a plurality of axial retention fingers extending from the cylindrical sleeve along the elongate axis.

12. The interface port accessory of claim 9 wherein the post engager includes at least three equiangular axial retention fingers each having an arcuate shoulder configured to engage a ring-shaped retention lip of the post.

13. The interface port accessory of claim 12 wherein each end of the respective axial retention finger comprises an inclined surface for slideably engaging an inclined surface of the post, the inclined surfaces of the post engager and the post spreading the end of each axial retention finger in a radial direction such that, when the post is fully received within the port body, the axial retention fingers bias the arcuate shoulders of the post engager radially into engagement with the ring-shaped retention lip of the post.

14. The interface port accessory of claim 9 wherein the spring assembly is operably coupled to the actuator such that axial displacement of the actuator away from the post causes the actuator to disengage the post engager from the post.

15. The interface port accessory of claim 9 wherein the spring assembly includes first and second biasing elements, wherein the first biasing element interposes the post engager and the port body to bias the post against the port body in the first operating mode and wherein the second biasing element interposes the actuating collar and the port body to bias the collar forwardly in the second operating mode.

16. The port accessory of claim 15, wherein the post engager includes a bi-directional flange and wherein the first biasing element is disposed between the radially projecting ridge of the port body and the bi-directional flange of the post engager.

17. The port accessory of claim 15, wherein the post engager includes a bi-directional flange and wherein the second biasing element is disposed between a forwardly facing shoulder of the port body and the bi-directional flange of the post engager.

18. The interface port accessory of claim 13, wherein the actuator includes a collar circumscribing the axial retention fingers of the post engager and an expansion ring interposing the port body and an underside of each axial retention finger, and wherein axial displacement of the collar away from the post causes the expansion ring to: (i) expand radially, (ii) move the arcuate shoulder of each the axial retention finger outwardly, and (iii) release the arcuate shoulder from engagement with the ring-shaped retention lip of the post.

19. The interface port accessory of claim 9, wherein the post engager comprises plurality of axial retention fingers extending along the elongate axis, a cylindrical sleeve and a bi-directional flange integral with, and extending radially from the cylindrical sleeve, the bi-directional flange having an aperture configured to receive the port body, the axial retention fingers integrated with cylindrical sleeve and being disposed about the port body, each axial retention finger comprising an arcuate shoulder at an end opposite the bi-directional flange and defining a cantilever spring for biasing the arcuate shoulder radially into engagement with a ring-shaped retention lip of the post, the actuator comprising a collar circumscribing the axial retention fingers, and a driver assembly operative to release the arcuate shoulder of each axial retention finger from engagement with the ring-shaped retention lip of the post in response to axial displacement of the collar.

20. A method for detachably coupling a coaxial cable connector to an interface port comprising the steps of:

engaging a post of the coaxial cable connector by a post engager in a first operating mode, the post engager having a plurality of axial retention fingers extending along an elongate axis, each axial retention finger having an arcuate shoulder for engaging a ring-shaped retention lip of the post;

disengaging the post of the coaxial cable connector by an actuator configured to translate axially along the elongate axis to release the post engager from the post in a second operating mode, and biasing the axial retention fingers of the post engager in a direction tending to draw the post against the port body to produce an electrical ground path therebetween.

* * * * *